United States Patent [19]

Carson, Jr. et al.

[11] 4,348,119

[45] Sep. 7, 1982

[54] BOUNCE CONTROL SYSTEM FOR MOVING COIL PRINTING ELEMENT

[75] Inventors: Andrew B. Carson, Jr., Waynesboro; William A. Hanger, Churchville, both of Va.

[73] Assignee: General Electric Company, Waynesboro, Va.

[21] Appl. No.: 204,628

[22] Filed: Nov. 6, 1980

[51] Int. Cl.[3] ..... B41J 3/10; B41J 7/84; B41J 9/42

[52] U.S. Cl. ..... 400/121; 101/93.02; 400/157.2; 400/167

[58] Field of Search ..... 361/152, 153, 154; 101/93.02, 93.03; 400/121, 157.2, 157.3, 166, 167

[56] References Cited

U.S. PATENT DOCUMENTS

| | | | |
|---|---|---|---|
| 3,172,353 | 3/1965 | Helms | 101/93.03 |
| 3,351,006 | 11/1967 | Belson | 101/93.02 |
| 3,507,213 | 4/1970 | Derc | 101/93.02 |
| 3,678,847 | 7/1972 | Pear et al. | 101/93.02 |
| 3,741,113 | 6/1973 | Mako et al. | 101/93.02 |
| 3,866,533 | 2/1975 | Gilbert et al. | 101/93.14 |
| 4,027,761 | 6/1975 | Quaif | 101/93.03 X |
| 4,062,285 | 12/1977 | Deetz et al. | 101/93.02 |
| 4,192,230 | 3/1980 | Blom et al. | 400/157.3 X |
| 4,291,992 | 9/1981 | Barr et al. | 400/124 |

*Primary Examiner*—Paul T. Sewell
*Attorney, Agent, or Firm*—Michael Masnik

[57] ABSTRACT

In a drive circuit for an electromagnetic printing element of an impact printer, a drive pulse drives the printing element from a backstop toward a record medium to print indicia. A voltage comparator senses the change in the induced voltage in the printing element when it impacts on the backstop for triggering a single shot circuit to apply to the printing element a damping pulse of a polarity such as to oppose its rebound from the backstop. A latch circuit is responsive to the damping pulse to disable the single shot circuit until the end of the next drive pulse. The drive and damping pulses are applied to the printing element through a bidirectional current source.

14 Claims, 9 Drawing Figures

BOUNCE CONTROL SYSTEM FOR MOVING COIL PRINTING ELEMENT

BACKGROUND OF THE INVENTION

The present invention relates to the control of printing heads, particularly for impact printers such as dot matrix printers operating at very high data rates. In particular, this invention relates to control of bounce of the printing element on the backstop at the end of a printing cycle.

This invention applies to printers which develop a force whose direction is a function of the direction of the driving pulse. Generally, these involve a plurality of printing elements, each including a moving electromagnetic coil in a magnetic field, having attached thereto a print wire or stylus, the styli being arranged in one or more vertical lines and being maintained in a spaced-apart arrangement in a print head. One such print head is disclosed in U.S. Pat. No. 4,129,390, granted to J. E. Bigelow et al on Dec. 12, 1978, and comprises a stacked array of flat blade type printing elements.

Each printing element or blade has associated therewith a drive circuit for controlling the operation thereof. Signals from an associated source such as a keyboard are fed to a matrix encoder which converts them to signals of the matrix format for controlling the print wire drive circuits. The drive circuits usually tend to supply constant energy drive pulses, based upon the assumption that constant energy drive pulses always produce constant impact forces and uniform print density.

Each printing element is normally biased against a backstop and, when a drive pulse is applied to the printing element, it is driven from the backstop toward a record medium for printing indicia, the printing element then rebounds to the backstop. Ideally, the backstop would absorb all of the kinetic energy of the printing element and stop it dead still. Practically speaking, however, backstops are incapable of performing this way. Thus, the printing element will rebound from the backstop and move along a path back toward the record medium. If the energy remaining in the printing element after backstop rebound is sufficient, the printing element may rebound all of the way to the record medium and cause a spurious dot to be printed. Even if the rebound is only part way to the record medium, the printing element, being displaced from its normal rest position, is not positioned to respond favorably or accurately to a subsequent drive pulse, nor will it be until it reaches quiescence at or near the backstop. Thus, there is an inherent delay and significant reduction in maximum printing speed, since the minimum time interval between succeeding drive pulses applied to a printing element must be at least as great as the time required for the printing element to move from the backstop to the printing medium and back again.

Several attempts have been made in the past to overcome the problem of bounce of the printing element. U.S. Pat. No. 3,172,353, which issued to C. J. Helms on Mar. 9, 1965, discloses means for extending the length of the drive pulses beyond the time at which a print hammer strikes the record medium so that the print head magnetic field will oppose the print hammer rebound and thereby dissipate a portion of the rebound energy so as to minimize backstop wear. This type of system presumes an accurately fixed travel distance of the printing element between the backstop and the record medium, since the ratio of the accelerating portion of this drive pulse to the returning portion thereof is fixed.

In many matrix printers, on the other hand, the travel distance is variable within relatively wide limits, depending upon the wear of the backstop, thickness of the paper, etc. Furthermore, by applying braking current during the printing dwell time that the printing element is in engagement with the record medium and during a portion of the return flight of the printing element to the backstop serves to increase the dwell on the record medium and to reduce the return velocity toward the backstop. Thus, the round trip time for the printing element is significantly increased, thereby reducing the speed capability of the printer. In this regard, it is significant that the prior art patent relates to a line printer wherein each print hammer is located at a given column location and prints a complete character. In such printers, the repetitive capability of the printing element is not nearly so important as in a matrix printer since such elements may operate only once for each line of print when printing fully formed characters. Finally, by extending the drive pulse through and beyond the point of impact of the printing element with the record medium, prior art systems expend significant amounts of additional energy and always adds to the heat that must be dissipated by the hammer drive.

U.S. Pat. No. 3,678,847, which issued July 25, 1972 to C. B. Pear, Jr. et al, discloses a circuit for applying a damping pulse to the printing element during its return flight to the backstop. This system, like the earlier mentioned approach, increases the round trip travel time of the print hammer and increases heat energy accordingly.

SUMMARY OF THE INVENTION

The present invention relates to an improved drive circuit for the printing elements of a high speed matrix printer which develops a force whose direction is a function of the direction of the driving current which overcomes the disadvantages of prior systems while affording additional operational advantages.

It is a general object of this invention to provide a drive circuit for a matrix printer which effectively controls the bounce of the printing element from the backstop.

In connection with the foregoing object, it is another object of this invention to provide a system of the type set forth, which does not add to the round trip travel time of the printing element between the backstop and the record medium.

It is still another object of this invention to provide a drive system of the type set forth which adds less significantly to the energy consumption of the print head and the heat dissipation thereof.

It is still another object of this invention to provide a drive system of the type set forth which permits accurate and effective control of printing element bounce despite variations in the velocity of the printing element and the length of the path traveled thereby between the backstop and the record medium.

These and other objects of the invention are attained by providing in an impact printer, having a movable electromagnetic printing element biased toward a backstop and a source of drive pulses for moving the printing element from the backstop toward a record medium to print indicia, the improvement comprising damping means coupled to the printing element for applying thereto a damping pulse after impact thereof on the backstop to oppose the rebound of the printing element from the backstop.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages, of the invention.

DESCRIPTION OF THE PREFERRED EMBODIMENT

Figure 1:
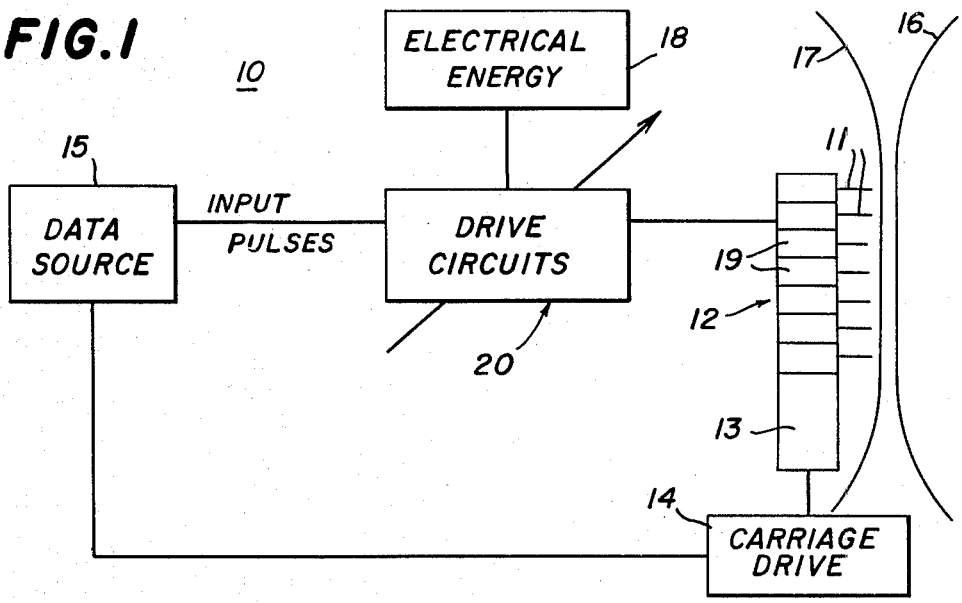
FIG. 1 schematically illustrates a high speed matrix printer incorporating printing element drive circuits constructed in accordance with and embodying the features of the present invention.

Referring to FIG. 1, there is schematically illustrated a dot matrix printer, generally designated by the numeral 10, which includes a plurality of print wires or styli 11, which are arranged in a vertical line. These styli 11 are maintained in a spaced-apart arrangement in a print head 12. The print head 12 is supported on a carriage 13 which is in turn driven by a carriage drive 14. Data from a data source 15 controls the carriage drive 14 for moving the carriage 13 across a line on a record medium 16, such as paper, in both directions in front of an ink ribbon 17. The data source 15 also provides input pulses defining the symbols to be printed for successive column positions of the carriages 13 during its movement across the record medium 16.

Connected to the data source 15 and to a source 18 of electrical energy is an assembly of drive circuits, generally designated by the numeral 20, for driving the printing elements 19 of the print head 12. Each stylus 11 is mounted on a separate printing element or blade 19, which includes an electromagnetic coil 19*a* (see FIG. 4) and is movable between a backstop (not shown) against which it is normally biased and the record medium 16. There is a separate drive circuit 20 for each printing blade 19 for selectively applying thereto drive pulses for driving the printing blade 19 toward the record medium 16 for printing indicia thereon.

The movement of an individual printing blade 19 is illustrated by reference to FIG. 2, the waveform 21 indicating the displacement of the printing blade 19 and the waveform 22 indicating the current of a drive pulse applied to the printing blade 19. The drive pulse 22 lasts for the time period A and accelerates the printing blade 19 into motion toward the record medium 16, as indicated by the upward slope of the displacement curve 21. After the drive pulse 22 ceases, the printing blade 19 coasts, or undergoes a ballistic motion during the time period B until it impacts upon the print ribbon 17, record medium 16 and associated platen, which will be collectively referred to hereinafter as the record medium. The printing blade 19 remains in contact with the record medium during a dwell time C, during which the kinetic energy of the printing blade 19 is converted into potential energy stored during the dwell period, and then retranslated into kinetic energy which drives the printing blade 19 back toward its rest position during a time period D, at the end of which time period the printing blade 19 impacts on the backstop. Time period E represents the dwell time of the printing blade 19 upon the backstop, during which time the kinetic energy of the printing blade 19 is converted to potential energy and, if sufficient, this potential energy is reconverted to kinetic energy for driving the printing blade 19 along a rebound path 23 back toward the record medium 16.

Figure 2:
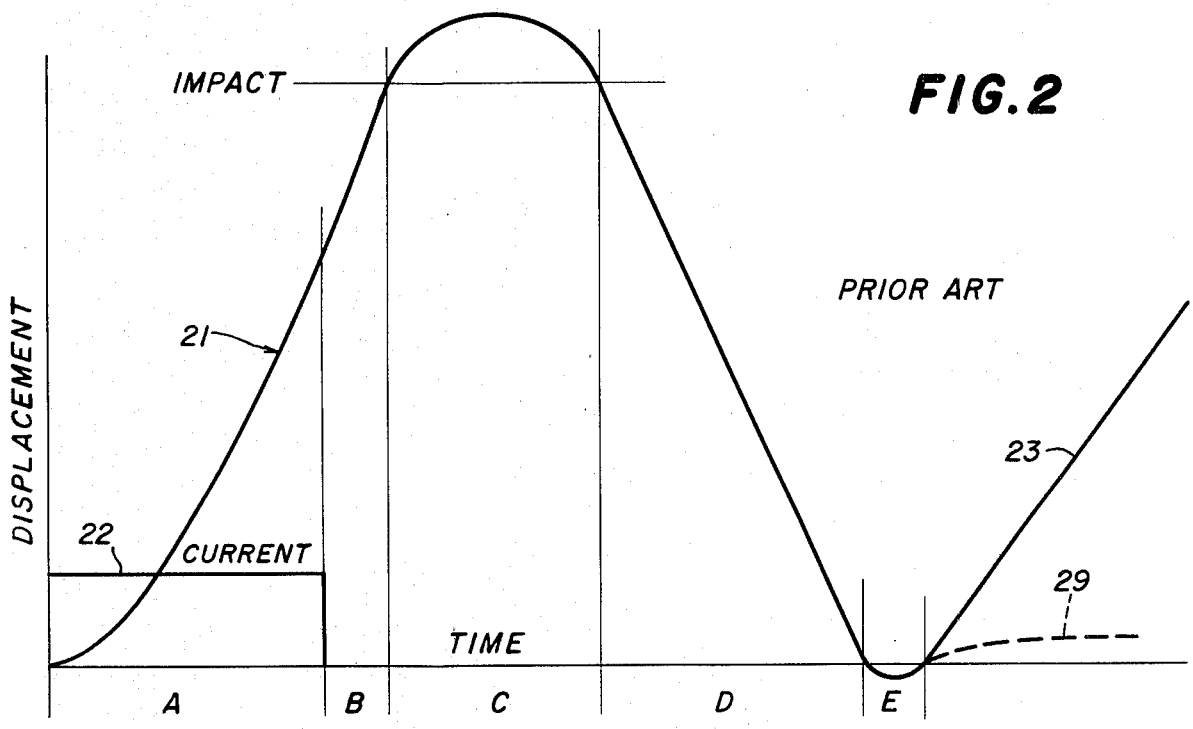
FIG. 2 is a waveform diagram illustrating the displacement of the printing element over time.
Figure 3:
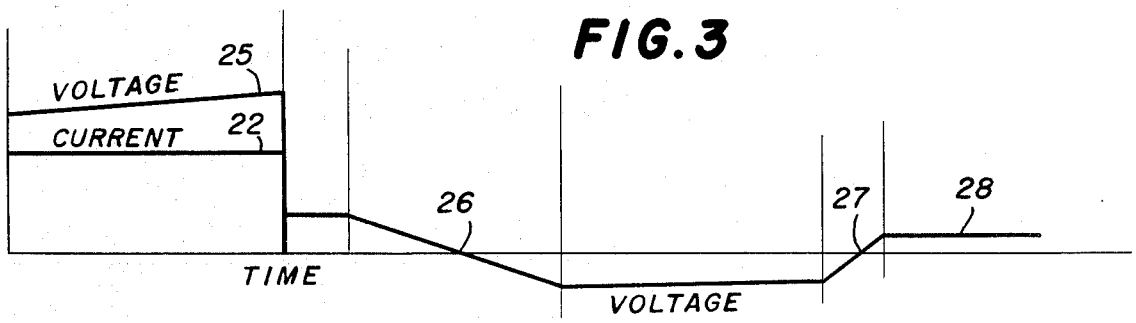
FIG. 3 is a waveform diagram on the same time base as FIG. 2 and illustrating the voltage and current in the printing element coil.

In FIG. 3 there is illustrated the current drive pulse 22 and the corresponding voltage 25 across the printing blade coil 19*a* during the periods A through E illustrated in FIG. 2. A constant current source for the drive pulse is illustrated, but it will be understood that since the coil 19*a* is moving in a magnetic field, it will generate a voltage (back emf) of its own which will constantly increase during the period A when the drive pulse 22 is applied, thereby accounting for the increase in the voltage waveform 25 during the period A. When the drive pulse 22 is terminated, the generated voltage in the coil 19*a* remains during the time period B, this voltage being proportional to velocity and changing polarity with the direction of the printing blade 19. Thus, when the printing blade 19 impacts on the record medium 16 at the end of time period B, it is rapidly stopped and the generated voltage thereof rapidly decreases to zero, as at 26, at which time the potential energy in the system is reconverted to kinetic energy and the printing blade 19 is accelerated back toward the backstop, generating an opposite polarity voltage which increases in magnitude until the printing blade 19 leaves the record medium 16 at the end of time period C. As the printing blade 19 coasts toward the backstop during the time period D, the generated voltage is nearly constant because the return velocity is nearly constant. When the printing blade 19 impacts the backstop, the generated voltage in the coil 19*a* rapidly decreases to zero, as at 27 as the printing blade 19 halts transiently, and then reverses polarity and increases as the printing blade 19 rebounds from the backstop, until it leaves contact with the backstop, as at 28.

It is a fundamental feature of the present invention that it utilizes this changing polarity of the voltage generated in the coil 19*a* to control the application of a damping pulse to the coil 19*a* for limiting the rebound of the printing blade 19 from the backstop. By the use of the present invention, the amplitude of the rebound can be substantially reduced to a much lower trajectory, as indicated by the dashed line at 29 in FIG. 2.

Figure 4:
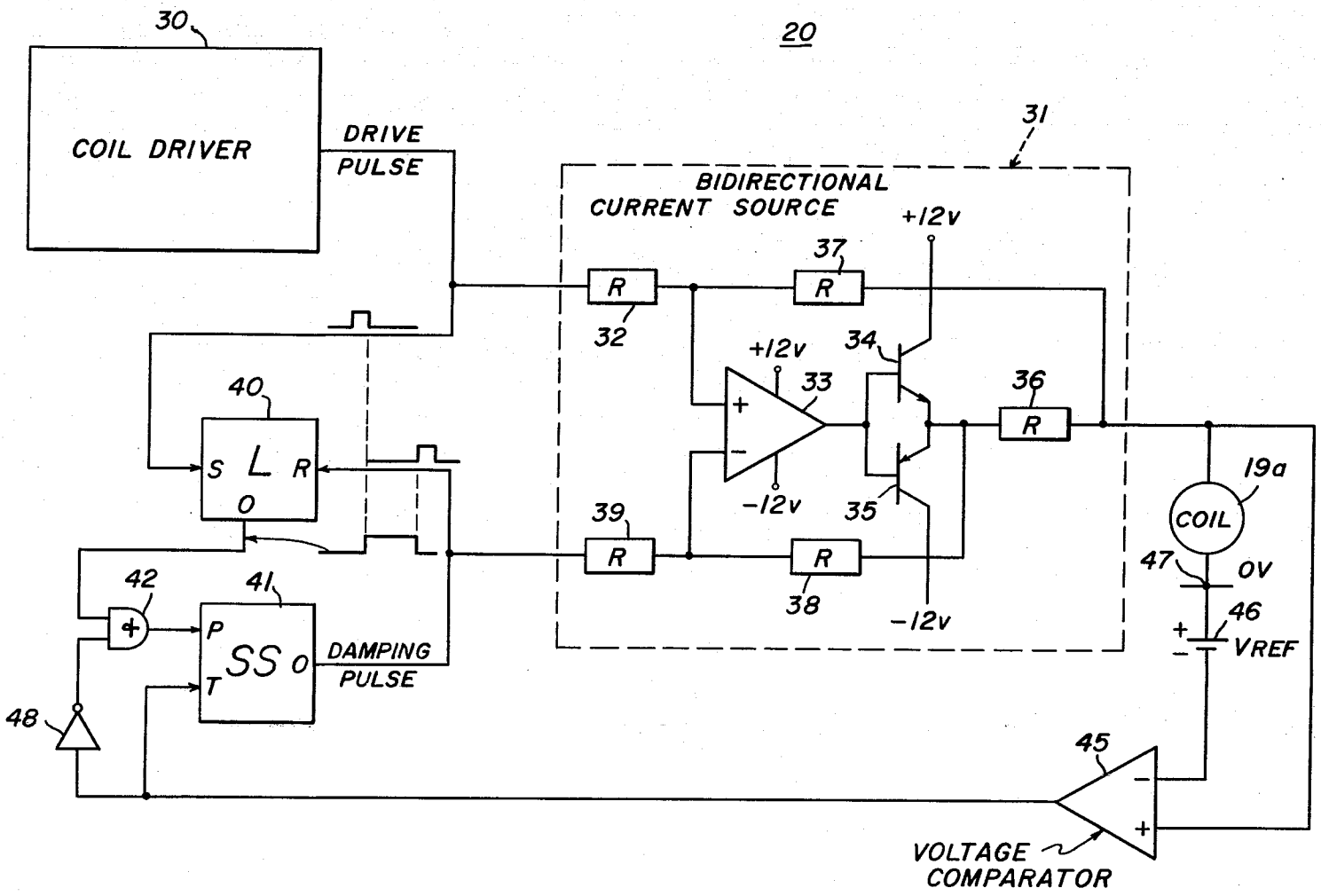
FIG. 4 is a schematic circuit diagram of the printing element drive circuit of the present invention.

Referring now to FIG. 4 of the drawings, there is illustrated one of the drive circuits 20 of the present invention for applying energizing pulses to the electromagnetic coil 19*a* of a printing blade 19. The drive circuit 20 includes a coil driver 30 which produces drive pulses of voltage in response to the input pulses from the data source 15. The drive pulses are converted to current pulses and applied to the coil 19*a* by a bidirectional current source, generally designated by the numeral 31. More specifically, the bidirectional current source 31 includes a resistor 32 which is connected between the output of the coil driver 30 and the noninverting input of a differential amplifier 33, the output of which is connected to the bases of two transistors 34 and 35 arranged in push-pull relationship. The transistor 34 is an NPN transistor having the collector thereof connected to a +12 volt supply and the emitter thereof connected to the emitter of the transistor 35, which is a PNP transistor having the collector thereof connected to a −12 volt supply. The emitters of the transistors 34 and 35 are connected via a resistor 36 to one terminal of the coil 19*a*. A feedback resistor 37 is connected between the coil 19*a* and the noninverting input terminal of the differential amplifier 33. A feedback resistor 38 is connected between the emitters of the transistors 34 and 35 and the inverting input terminal of the differential amplifier 33.

The inverting input terminal of the differential amplifier 33 is also connected via a resistor 39 to the reset terminal of a latch circuit 40 and to the output terminal of a triggered single shot circuit 41. The set terminal of the latch circuit 40 is connected to the output of the coil driver 30, and the output terminal of the latch circuit 40 is connected to one of the two input terminals of an AND gate 42, the output terminal of which is connected to a permit terminal of the single shot circuit 41. The one terminal of the coil 19*a* is also connected to the noninverting input terminal of a voltage comparator 45, the inverting input terminal of which is connected to a source of regulated voltage 46, the positive terminal of which is connected to the other terminal of the coil 19*a*. The output terminal of the voltage comparator 45 is connected to the trigger terminal of the single shot circuit 41 and, through an inverter 48, to the other input terminal of the AND gate 42.

Figure 5:
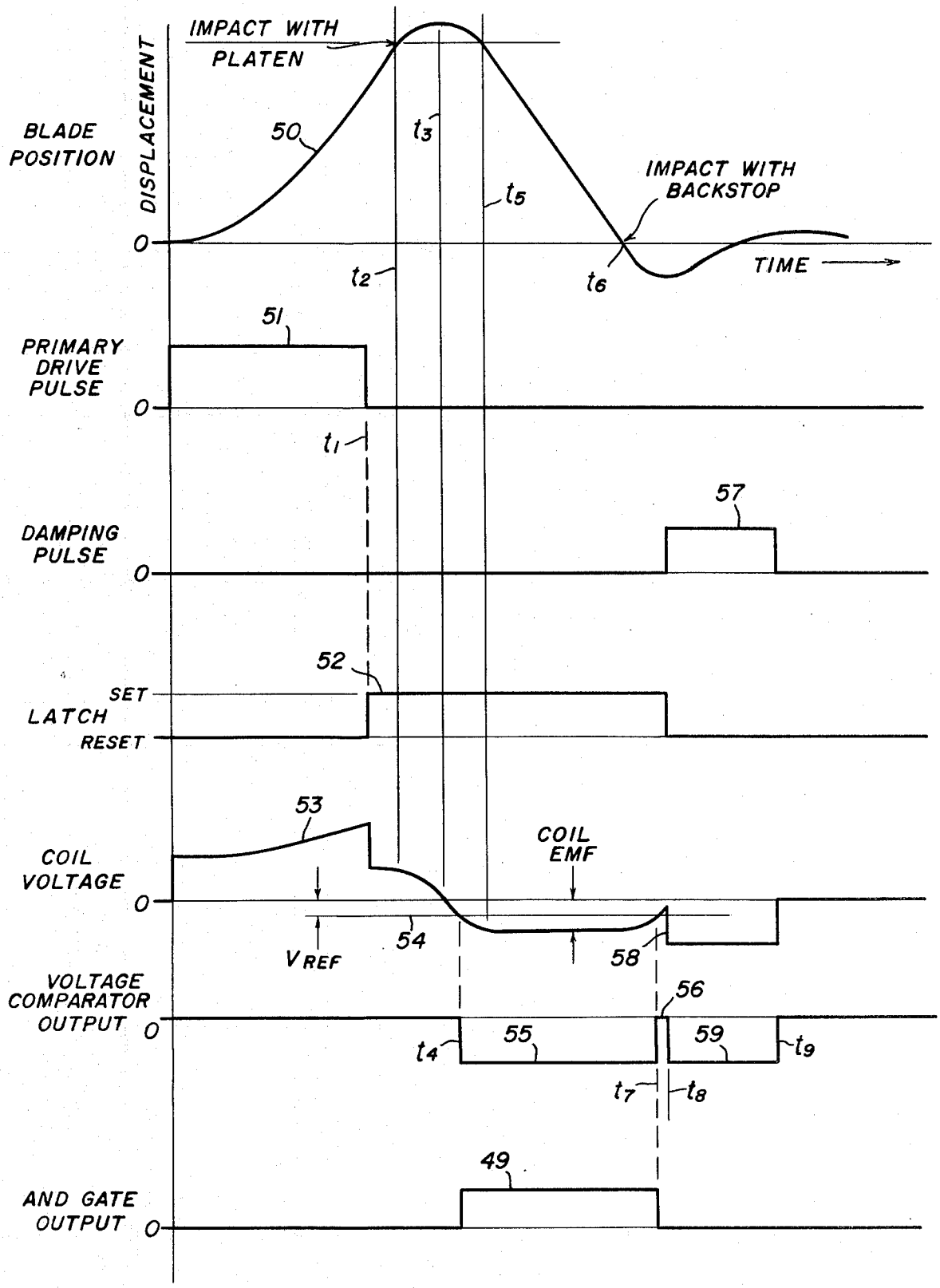
FIG. 5 is a set of waveforms illustrating the operation of the circuit of FIG. 4.

Referring now also to FIG. 5 of the drawings, the operation of the drive circuit 20 will be described in detail. The present invention takes advantage of the moving coil nature of the printing blade 19. Thus, while a drive pulse of one polarity will accelerate the printing blade 19 in a direction toward the record medium 16 for printing, conversely a current pulse of opposite polarity, when applied to the coil 19*a*, will accelerate the printing blade 19 in the opposite direction. Furthermore, since the coil 19*a* is moving in a magnetic field, it generates a back emf, the polarity of which changes with the direction of movement of the printing blade 19, and the magnitude of which is proportional to the velocity of the printing blade 19. It is a fundamental feature of the present invention that the change in this generated voltage when the printing blade 19 impacts on the backstop is sensed and utilized to trigger the application to the coil 19*a* of a damping pulse of opposite polarity to the drive pulse for accelerating the printing blade 19 toward the backstop in opposition to the rebound motion thereof. It should be noted that the moving element has far less kinetic energy after coming off the backstop than prior to hitting it. Thus by applying the damping pulse after striking the backstop, less energy is required which adds much less heat to the print head.

In accomplishing this, a drive pulse from the coil driver 30 is applied to the bidirectional current source 31, which in turn produces a primary drive pulse 51 of current for application to the coil 19*a*. The bidirectional current source 31 is balanced when input voltage between the inverting and noninverting input terminals of the differential amplifier 33 is zero. When a voltage drive pulse is applied to the differential amplifier 33 through the resistor 32, the output of the differential amplifier 33 swings positive, rendering the transistor 34 conductive and biasing the transistor 35 off, for producing a positive current pulse through the small current shunt resistor 36 to the coil of the printing blade 19 for accelerating it toward the record medium 16, as indicated by the displacement curve 50 in FIG. 5.

The drive pulse 51 from the coil driver 30 is also applied to the set input of the latch circuit 40, and at the termination of the drive pulse, the latch circuit 40 produces an output which is applied to the AND gate 42 at time $t_1$, as indicated at 52 in FIG. 5.

As the printing blade 19 accelerates toward the record medium 16, the voltage thereacross increases by the amount of the back emf generated in the coil 19*a*, as indicated by the coil voltage curve 53 in FIG. 5. At the end of the current drive pulse 51, the printing blade 19 stops accelerating and essentially coasts, or undergoes ballistic movement the rest of the way to the record medium 16, the voltage across the coil dropping to the amount of the back emf generated thereby, which will remain substantially constant until the printing blade 19 contacts the record medium 16 at time $t_2$. After impact with the record medium 16, the printing blade 19 will continue to move a very slight distance as it compresses the record medium to print the indicia, coming to a complete stop at time $t_3$. During the rapid deceleration of the printing element 19 after impact with the record medium 16, the voltage induced in the coil 19*a* rapidly collapses to zero at time $t_3$. The printing blade 19 then rebounds from the record medium 16 as the potential energy in the printing blade bias means and in the compressed record medium 16 is converted to kinetic energy for returning the printing blade 19 to the backstop. The voltage generated in the coil 19*a* changes polarity and increases from zero until the printing blade 19 leaves contact with the record medium at time $t_5$, after which the printing blade 19 will continue to coast back toward the backstop, with the generated emf in the coil 19*a* remaining nearly constant.

The voltage comparator 45 is so arranged that the output thereof is high until the voltage applied to the noninverting terminal thereof achieves a negative magnitude greater than that of the reference voltage $V_{Ref}$ established by the battery 46. As indicated above, $V_{Ref}$ is set at a level which is between zero and the maximum generated voltage achieved in the coil 19*a* on its return path to the backstop. Thus, it can be seen in FIG. 5 that the generated voltage in the coil 19*a* will cross the reference level $V_{Ref}$ at time $t_4$, causing the output of the voltage comparator 45 to go low, as at 55. When the output of the voltage comparator 45 goes low at time $t_4$, this output signal is inverted by the inverter 48 and applied to the AND gate 42, which produces at its output a signal which enables the triggered single shot 41, as indicated at 49 in FIG. 5.

When the printing blade 19 impacts on the backstop at time $t_6$, it slightly compresses the backstop and rapidly decelerates to a complete stop, the negative generated coil voltage rapidly collapsing to zero. When the generated voltage of the coil 19*a* crosses above the $V_{Ref}$ level at time $t_7$, the output of the voltage comparator 45 goes high, as at 56, thereby triggering the now enabled single shot 41. Note that prior to the impact of the printing blade 19 on the record medium 16 the single shot circuit 41 could not be triggered, even though the output of the voltage comparator 45 was high, because the enabling signal had not yet been applied from the AND gate 42.

After a slight circuit response time delay, the single shot circuit 41 produces at its output terminal a damping pulse 57 at time $t_8$, which damping pulse resets the latch circuit 40 and is applied to the bidirectional current source 31 via the resistor 39. The bidirectional current source 31 produces a negative going current pulse through the transistor 35 and resistor 36 which is applied to the coil 19*a* for accelerating it in a direction toward the backstop. This damping current opposes the voltage generated in the coil 19*a* as it rebounds from the backstop and back toward the record medium 16. The negative going damping current drives the voltage across the coil 19*a* back below the reference level $V_{Ref}$, as at 58, whereupon the output of the voltage comparator 45 again goes low, as at 59. At the termination of the damping pulse at time $t_9$, the output of the voltage comparator 45 again goes high, but the single shot 41 is not retriggered, the enabling signal having been removed therefrom when the latch circuit 40 was reset, thereby terminating its output signal.

Figure 6:
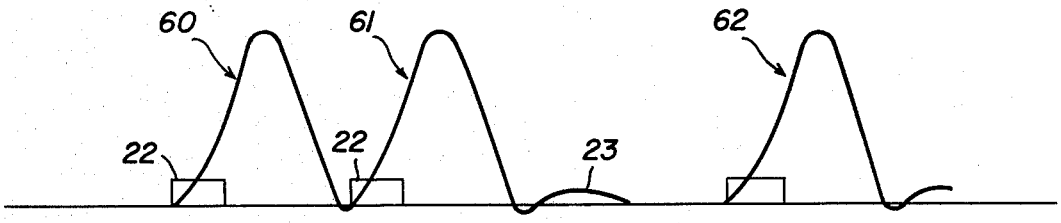
FIG. 6 is a waveform diagram illustrating various repetition rates for a printing element in a matrix printer.

Printing does not always result in the maximum possible repetition rate of the printing blade 19. A printing blade may be called upon to operate after any time interval up to the minimum possible, as indicated in FIG. 6, which shows several displacement waveforms, idealized in the sense that they do not show the normal large rebound from the backstop. More specifically, there is illustrated a first displacement waveform 60 resulting from a drive pulse 22, followed immediately, at the maximum repetition rate, by a second drive pulse 22 to produce a second printing displacement 61 of the print blade 19. The next drive pulse may not occur until the rebound 23 of the print blade is completely damped out, causing a new displacement of the printing blade 19 as at 62.

Figure 7:
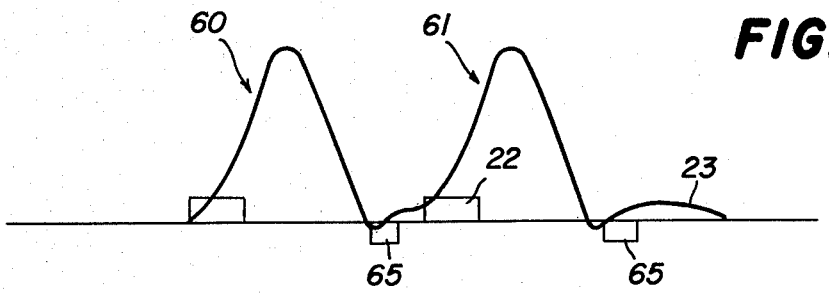
FIG. 7 is a waveform diagram like FIG. 6 and illustrating the operation of the drive system of the present invention at a moderate repetition rate.

FIG. 7 illustrates a situation where the repetition rate of the drive pulses 22 is near, but not at a maximum. With the present invention, after the initial displacement 60 of the printing blade 19, a damping pulse 65 is applied to minimize the rebound from the backstop. Thus, when the next drive pulse 22 occurs, the printing blade 19 is nearly at rest and, therefore, the displacement 61 thereof is very nearly the same as the initial displacement 60.

Figure 8:
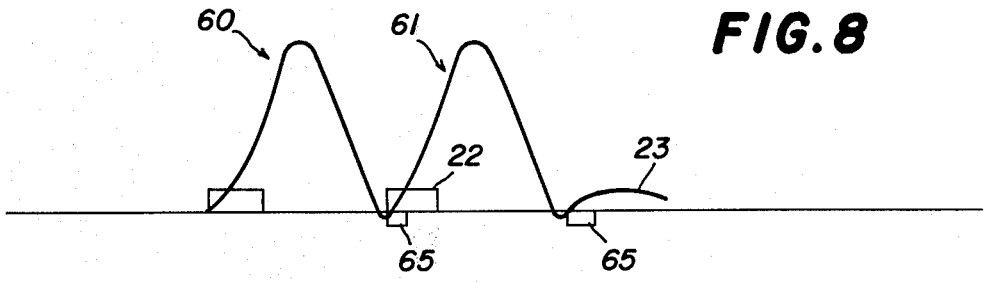
FIG. 8 is a waveform diagram like FIG. 7 and illustrating the operation of the system of the present invention at a high repetition rate.
Figure 8A:
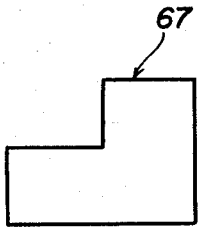
FIG. 8A is a waveform diagram illustrating the resultant drive pulse applied to the printing element at the repetition rate of FIG. 8 with the present invention.

As the repetition rate is further increased, the damping pulse 65 will partially or even completely coincide with the next drive pulse 22, as illustrated in FIG. 8. Whenever coincidence occurs, a portion or all of the energy of the damping pulse 65 is subtracted from that of the drive pulse 22. Thus, in the event of complete overlap of these pulses, a resultant drive pulse 67 illustrated in FIG. 8A is applied to the printing blade 19.

Thus, at maximum repetition rates, the present invention affords several important advantages. A significant feature of the present invention is that the damping pulse is applied after the printing blade 19 impacts on the backstop. This permits the overlap of the damping and driving pulses at maximum repetition rates, as described above, thereby avoiding overdriving of the printing blade 19 so as to achieve improved evenness of dot intensity, without increasing the energy consumption and heat dissipation.

Furthermore, the round trip travel time of the printing blade 19 from the backstop to the record medium 16 and back again is not increased, as it is in some prior art systems where the damping pulse is applied during the return flight of the printing blade 19 from the record medium 16. Thus, the high speed capability of the printer is not impaired by the present invention.

Additionally, by generating the damping pulse in response to the impact of the printing blade 19 on the backstop, the present invention applies the damping pulse exactly when it is needed and eliminates the guesswork of the prior systems which apply the damping pulse some predetermined time after the drive pulse. Such prior systems cannot take account of slight variations in the travel distance of the printing blade 19.

Finally, less damping energy is required when the damping pulse is applied after impact of the printing blade 19 on the backstop. This is because the damping pulse must remove a fixed percentage of the system energy that existed prior to its application. If applied before impact with the backstop, the system energy is higher (since none has been dissipated in the backstop) and, therefore, the fixed percentage of it is higher too, requiring a higher energy pulse for damping.

Since the present invention utilizes the changes in the voltage generated in the printing blade coil to trigger the damping pulse, it will be appreciated that either the magnitude or the change of direction of this generated coil voltage could be utilized for the triggering action. While, in the preferred embodiment a reference level $V_{Ref}$ has been established to set the trigger point in order to mask any circuit noise or common impedance drops from companion blade drivers so as to prevent inadvertent tripping of the voltage comparator 45, it will be appreciated that the system could also be operated without this artificial reference level, utilizing simply the zero voltage crossings of the coil emf for triggering the damping pulse.

From the foregoing, it can be seen that there has been provided an improved system for controlling the bounce of a printing blade against the backstop, which system achieves reduced energy usage and heat dissipation, improved evenness of dot intensity and does not impair the maximum speed of operation of the printer.

What we claim as new and desire to secure by Letters Patent of the United States is:

1. In an impact printer which develops a force whose direction is a function of the direction of the driving current, said printer comprising a movable electromagnetic printing element located adjacent a backstop and a source of drive pulses for moving the printing element from the backstop toward a record medium to print indicia, damping means coupled to the printing element and responsive to impact of the printing element on the backstop for applying to said printing element a damping pulse after impact theref on the backstop to oppose the rebound of the printing element from the backstop.

2. The improvement of claim 1, wherein said damping means includes a source of damping pulses coupled to the printing element, and trigger means coupled to the printing element and to the source of damping pulses and responsive to impact of the printing element on the backstop for applying a trigger signal to said source of damping pulses, said source of damping pulses being responsive to said trigger signal for applying a damping pulse to the printing element.

3. The improvement of claim 2, wherein said trigger means is responsive to the voltage across the printing element.

4. The improvement of claim 1, wherein said damping means includes means responsive to the collapse of the generated voltage across the printing element when it impacts on the backstop for actuating said damping means to apply a damping pulse to the printing element.

5. The improvement of claim 1, and further including means establishing a reference voltage level which is between zero and the maximum voltage generated in the printing element as it returns from the record medium to the backstop, and trigger means responsive to the collapse of the generated voltage in the printing element through said reference level when the printing element impacts on the backstop for actuating said damping means to apply a damping pulse to the printing element.

6. The improvement of claim 5, wherein said trigger means includes a voltage comparator.

7. The improvement of claim 1, wherein said damping means includes a source of damping pulses, and coupling means connected to said source of damping pulses and to the source of drive pulses and to the printing element, said coupling means applying to the printing element a predetermined relationship of the drive and damping pulses in the event that they overlap in time.

8. The improvement of claim 7, wherein said coupling means includes a bidirectional current source for applying to the printing element a current of a first polarity in response to a drive pulse and a current of a second polarity in response to a damping pulse.

9. In an impact printer having a movable ellectromagnetic printing element biased toward a backstop and a source of drive pulses for moving the printing element from the backstop toward a record medium to print indicia; the improvement comprising a source of damping pulses coupled to the printing element for applying thereto a damping pulse after impact thereof on the backstop to oppose the rebound of the printing element from the backstop, and control means coupled to the source of drive pulses and to said source of damping pulses and responsive to the application of a damping pulse to the printing element for preventing application of another damping pulse to the printing element until after the next drive pulse.

10. The improvement of claim 9, wherein said control means is responsive to the application of a damping pulse to the printing element for preventing generation of a damping pulse until after the next drive pulse.

11. The improvement of claim 9, wherein said control means is responsive to the termination of the next drive pulse for re-enabling said source of damping pulses.

12. The improvement of claim 9, wherein said control means is responsive to the beginning of a damping pulse for preventing application of another damping pulse to the printing element.

13. The improvement of claim 9, and further including trigger means coupled to the printing element and to said source of damping pulses and responsive to impact of the printing element on the backstop for actuating said source of damping pulses to apply a damping pulse to the printing element.

14. In an impact printer which develops a force whose direction is a function of the direction of the driving current, said printer comprising a movable electromagnetic printing element located adjacent a backstop and a source of drive pulses for moving the printing element from the backstop toward a record medium to print indicia, damping means coupled to the printing element for applying thereto a damping pulse only after impact thereof on the backstop to oppose the rebound of the printing element from the backstop.

* * * * *